US007004892B2

(12) United States Patent
Marco

(10) Patent No.: US 7,004,892 B2
(45) Date of Patent: Feb. 28, 2006

(54) TRAINING DEVICE FOR AND METHOD FOR TRAINING GLIDING SPORT ATHLETE

(76) Inventor: Wendy G. Marco, 8 Brookmeade Ct., Potomac Falls, VA (US) 20165

( * ) Notice: Subject to any disclaimer, the term of this patent is extended or adjusted under 35 U.S.C. 154(b) by 56 days.

(21) Appl. No.: 10/372,804

(22) Filed: Feb. 26, 2003

(65) Prior Publication Data

US 2003/0130098 A1 Jul. 10, 2003

Related U.S. Application Data

(62) Division of application No. 09/734,723, filed on Dec. 13, 2000, now Pat. No. 6,551,221.

(51) Int. Cl.
*A63B 21/02* (2006.01)

(52) U.S. Cl. ..... 482/124; 482/66; 482/68; 434/258; 473/215

(58) Field of Classification Search ..... 463/3; 473/588, 415–422, 560, 570, 215; 280/818, 280/600, 1.5, 601, 5.24, 841, 14.1, 809; 482/66, 482/68, 124; 434/258; 602/19; D21/710, D21/771
See application file for complete search history.

(56) References Cited

U.S. PATENT DOCUMENTS

| | | | | | |
|---|---|---|---|---|---|
| 320,462 | A | * | 6/1885 | Cowing | 482/68 |
| 866,495 | A | * | 9/1907 | Marks | 482/124 |
| 923,556 | A | * | 6/1909 | Miller | 482/68 |
| 2,097,376 | A | * | 10/1937 | Marshman | 482/124 |
| 2,306,780 | A | * | 12/1942 | Copson | 482/66 |
| 2,900,008 | A | * | 8/1959 | Seger | 482/66 |
| 3,235,254 | A | * | 2/1966 | Robson | 482/66 |
| 3,695,609 | A | * | 10/1972 | Rothe | 482/66 |
| 4,005,859 | A | * | 2/1977 | Tait | 482/66 |
| 4,018,439 | A | * | 4/1977 | Kauk | 482/66 |
| 4,021,033 | A | * | 5/1977 | Auclair et al. | 482/66 |
| 4,114,873 | A | * | 9/1978 | Jones | 482/42 |
| 4,681,332 | A | * | 7/1987 | Malone | 280/87.021 |
| D301,598 | S | * | 6/1989 | Harris | D21/771 |
| D301,906 | S | * | 6/1989 | Coolen | D21/710 |
| 4,955,608 | A | | 9/1990 | Dougherty | |
| 5,033,734 | A | * | 7/1991 | Jalbert | 482/66 |
| 5,062,642 | A | | 11/1991 | Berry | |
| D323,692 | S | * | 2/1992 | Lukowski | D21/771 |
| 5,203,754 | A | * | 4/1993 | Maclean | 482/124 |
| 5,226,821 | A | * | 7/1993 | Murphy et al. | 434/247 |

(Continued)

OTHER PUBLICATIONS

Leg Harness Instructions, pp. 1-2, Improve Human Performance.

*Primary Examiner*—Gregory L. Huson
*Assistant Examiner*—L. Amerson
(74) *Attorney, Agent, or Firm*—Antonelli, Terry, Stout and Kraus, LLP.

(57) ABSTRACT

A training device for a gliding sport athlete trains the athlete to have the proper knee bend for gliding sports such as ice skating, inline skating, skiing, etc. The device includes a belt and a pair of foot attachments adapted to be fastened to a front portion of the respective feet or footwear of the athlete. One end of each pair of cords is connected to the belt at a position between the front portion and a respective side portion, and another end connected to one of the foot attachments. Each of the cords has an unstretched length less than a length between the athlete's waist and feet, to apply a force to urge the athlete's knee into a bent position.

20 Claims, 5 Drawing Sheets

U.S. PATENT DOCUMENTS 5,263,916 A * 11/1993 Bobich ..... 482/124
5,303,927 A * 4/1994 Perry et al. ..... 473/215
5,372,565 A * 12/1994 Burdenko ..... 482/124
5,647,827 A 7/1997 Gutkowski
D389,545 S * 1/1998 Gertler ..... D21/760
5,716,307 A 2/1998 Vadher
5,813,955 A * 9/1998 Gutkowski et al. ..... 482/124
5,820,534 A 10/1998 Vadher
5,860,944 A 1/1999 Hoffman, Jr.
5,993,362 A 11/1999 Ghobadi
6,129,691 A * 10/2000 Ruppert ..... 602/19
D433,475 S * 11/2000 Gonzalez ..... D21/771
6,165,084 A * 12/2000 Cranston ..... 473/422
6,537,077 B1 * 3/2003 Johnson ..... 434/258
6,634,998 B1 * 10/2003 Siaperas ..... 482/142
2004/0080150 A1 * 4/2004 Chen ..... 280/809
2004/0113414 A1 * 6/2004 Terry ..... 280/809

* cited by examiner 12
14
19b
19a
18b
18a
10
21
16
20
17

12
14
19b
19a
18b
18a
10
45
21
16
20
17
54

22a
24
34n
14

34b
34a
26
22b

TRAINING DEVICE FOR AND METHOD FOR TRAINING GLIDING SPORT ATHLETE

CROSS REFERENCE TO RELATED APPLICATION

This is a divisional application of U.S. application Ser. No. 09/734,723, filed Dec. 13, 2000 now U.S. Pat. No. 6,551,221.

BACKGROUND OF THE INVENTION

The present invention relates to a training device for and a method for training a gliding sport athlete. Various exercise devices and athletic movement training devices are known. For example, U.S. Pat. No. 4,955,608 to Dougherty et al discloses an athletic movement trainer comprising a belt, ankle straps and an elasticized, bungee-type cord. The cord passes through a ring, such as a screw eye, attached to the belt. Each end of the cord is adjustably connected to an ankle strap so that the cord will remain relaxed as long as the sportsman maintains the proper athletic position but will become tensioned when the athlete deviates from the correct posture or stance. Because the ring does not prevent all movement of the cord, the trainer merely resists, rather than restricts, the upward movement of the athlete. This patent discloses that the trainer helps develop the lower body muscle groups and assists the athlete in maintaining proper hitting stances, particularly in racket sports such as tennis and racket ball. Baseball, basketball and volleyball are also mentioned. However, no mention is made of gliding sports such as ice skating, inline skating, snow skiing, water skiing, surfing, snow boarding etc. In fact, the athletic movement trainer described in this patent would not be particularly helpful for a gliding sport athlete since the cord passes through a ring on the athlete's back and is connected to the back of ankle straps. This arrangement, in particular the cord being attached in back of the athlete and to the ankles, would not encourage the proper weight distribution in knee bend needed for a gliding sport athlete.

U.S. Pat. No. 5,062,642 to Berry et al discloses a training device worn by a user for strengthening and training the legs for various sports, in particular, golf. The Berry patent discloses a belt which extends around the waist of the user and an elastic strap which has two forward runs and two rearward runs. Each of the forward runs secures to the belt at an upper end along the front section of the belt. The forward runs extend down to a loop which receives the users foot while the rearward runs extend from the loop back to apertures located on the back section of the belt. Like the Dougherty et al patent, the Berry et al patent also makes no mention of gliding sports, and the training device disclosed therein would not be suitable for gliding sport athletes. The training device disclosed in the Berry et al patent would not encourage the proper knee bend or weight distribution necessary for gliding sports.

Gliding sports, especially skating, require an exaggerated knee-bend, i.e., a knee-bend such that the athlete's knee extends forward of the athlete's toes with a body lean forward. This position is not a natural position and is difficult to achieve while standing, walking, or even running without falling or holding on to something. In order to achieve this position, the athlete needs to be in a gliding motion with the potential to lean without falling or ride on an edge. It is for this reason that none of the currently available training devices work properly for gliding sports.

SUMMARY OF THE INVENTION

The present invention relates to a training device for and a method for training a gliding sport athlete. The device trains the athlete to have the proper knee bend for gliding sports such as ice skating, inline skating, snow skiing, water skiing, surfing, snowboarding, etc.

The device includes a belt for securing about the waist of the athlete, the belt having a front portion adapted to be worn adjacent the navel of the athlete, a right side portion adapted to be worn adjacent the right hip of the athlete, and a left side portion adapted to be worn adjacent the left hip of the athlete. A pair of foot attachments are adapted to be fastened to a front portion of the respective feet or footwear of the athlete. One end of a first pair of cords is connected to the belt at a position between the front portion and the right side portion, and another end connected to one of the foot attachments, and one end of a second pair of cords is connected to the belt at a position between the front portion and the left side portion, and another end connected to another of the foot attachments. Each of the cords has an unstretched length less than a length between the athlete's waist and feet.

In order to carry out the training, the belt is secured about the waist of the athlete, the belt having a front portion worn adjacent the navel of the athlete, a right side portion worn adjacent the right hip of the athlete, and a left side portion worn adjacent the left hip of the athlete, and left and right foot attachments fastened to a front portion of the respective left and right feet or footwear of the athlete. Two pairs of stretchable cords are provided, a first pair of cords having one end of each of the cords connected to the belt at a position between the front portion and the right side portion, and another end connected to the right foot attachment, and a second pair of cords having one end connected to the belt at a position between the front portion and the left side portion, and another end connected to the left foot attachment, each of the cords having an unstretched length less than a length between the athlete's waist and feet, so that the first pair of cords extends between the belt and the right foot attachment on each side of the right leg bent at the knee, and the second pair of cords extends between the belt and the left foot attachment on each side of the left leg bent at the knee. The stretched cords apply a force to urge the athlete's knee into a bent position.

DETAILED DESCRIPTION OF THE PREFERRED EMBODIMENTS

The present invention relates to a training device for and a method for training a gliding sport athlete. By the term "gliding sport," applicant means a sport in which the athlete, during at least some portion of the athlete's movement, glides along the surface on or over which the sport is played. Non-limitative examples of gliding sports include ice skating, inline skating, snow skiing, water skiing, surfing and snowboarding. One embodiment of the present invention will be described in connection with ice skating, although one skilled in the art would, based on the following description and the attached drawings, understand how the device can be used in training an athlete participating in other gliding sports.

Figure 1:
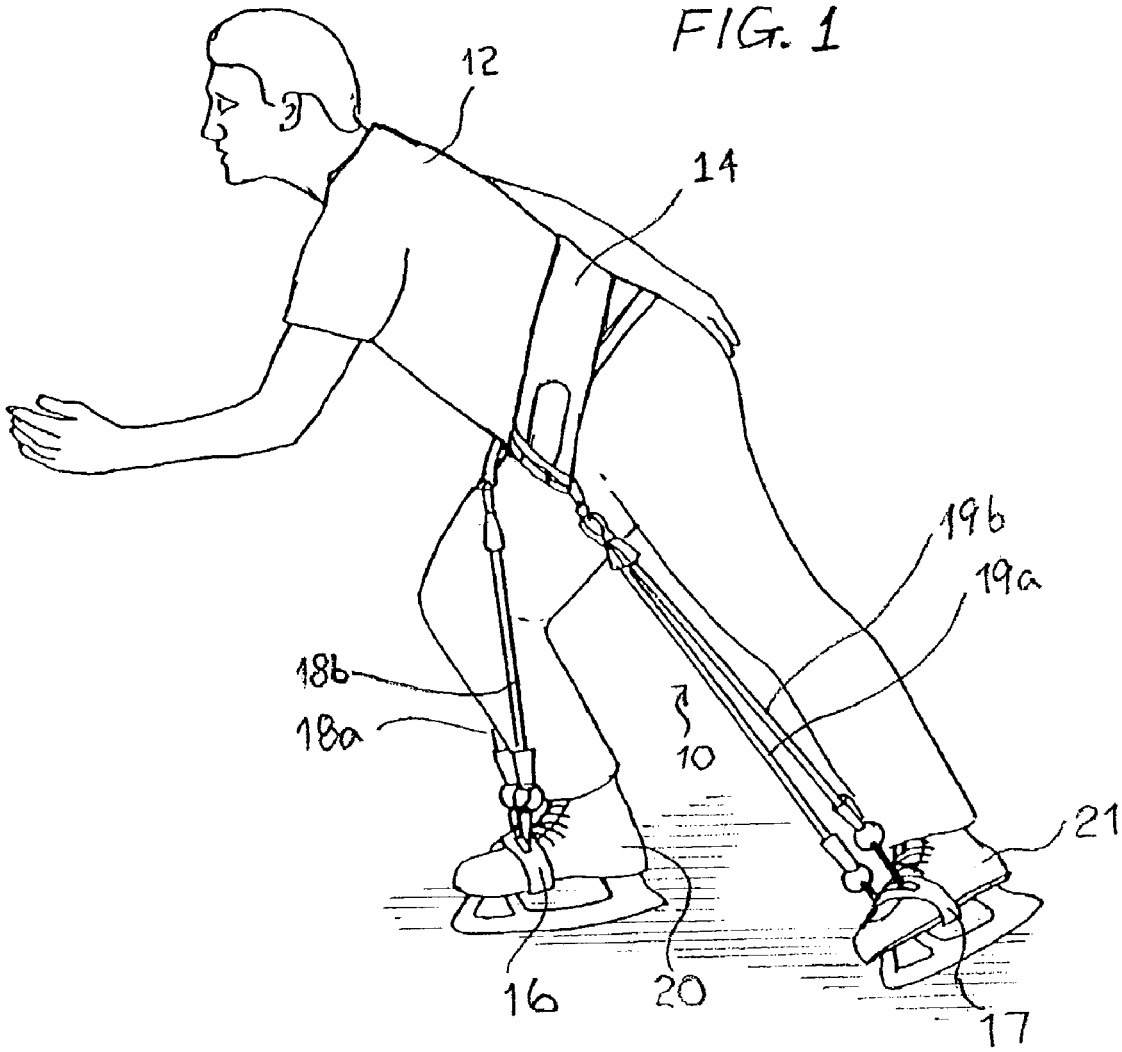
FIG. 1 is a schematic view of the training device of the present invention being used by an ice skater.

FIG. 1 is a schematic view showing the training device of the present invention, generally designated by the reference numeral 10, being used for training an ice skater 12. As shown in FIG. 1, the training device 10 includes a belt 14 for securing about the waist of the athlete 12. The training device 10 also includes a pair of foot attachments 16, 17 fastened to a front portion of the respective feet or footwear of the athlete 12, in this case to the right and left ice skates 20, 21, respectively, of the athlete 12. The first pair of cords 18*a*, 18*b* is connected between the belt and the right skate 20 of the athlete 12 while a second pair of cords 19*a*, 19*b* is connected between the belt 14 and the foot attachment 17 on the left skate 21 of the athlete 12. The attachments are shown in more detail in FIGS. 2–4.

The cords 18*a*, 18*b*, 19*a* and 19*b* are made of a stretchable, e.g., elastic material and have an unstretched length less than the length between the waist and feet of the athlete 12. For example, the cords 18*a*, 18*b*, 19*a*, 19*b* can be made of surgical tubing or can be bungee-type cords. In FIG. 1, the cords 18*a*, 18*b* are shown in the unstretched or slightly stretched state, while the cords 19*a*, 19*b* are in the stretched state. The training device 10 of the present invention can be made available with cords of different lengths and thicknesses to accommodate the size and strength of the athlete 12.

The resistance of the cords 18*a*, 18*b*, 19*a*, 19*b* to stretching urges the gliding sport athlete 12 into a proper position; i.e., since force is necessary to stretch the cords, the cords urge the gliding sport athlete 12, in this embodiment a skater, e.g., an ice skater, into the proper, knee bent position. As shown in FIG. 1, the cords 18*a*, 18*b* urge the right leg of the user 12 into a position with the right knee properly bent and forward of the toes. This pushes the chest forward, forces a lean, and puts the weight of the athlete 12 forward. The force of the cords also urges the return of each of the legs under the body after each stride. Simultaneously, because of the force needed to stretch the cords 19*a*, 19*b*, increased muscle strength is achieved by stretching the cords, as shown in connection with the left leg of the athlete 12 in FIG. 1.

In other gliding sports, the device acts to force the athlete into the proper gliding position and restricts deviations from that proper stance.

Figure 2:
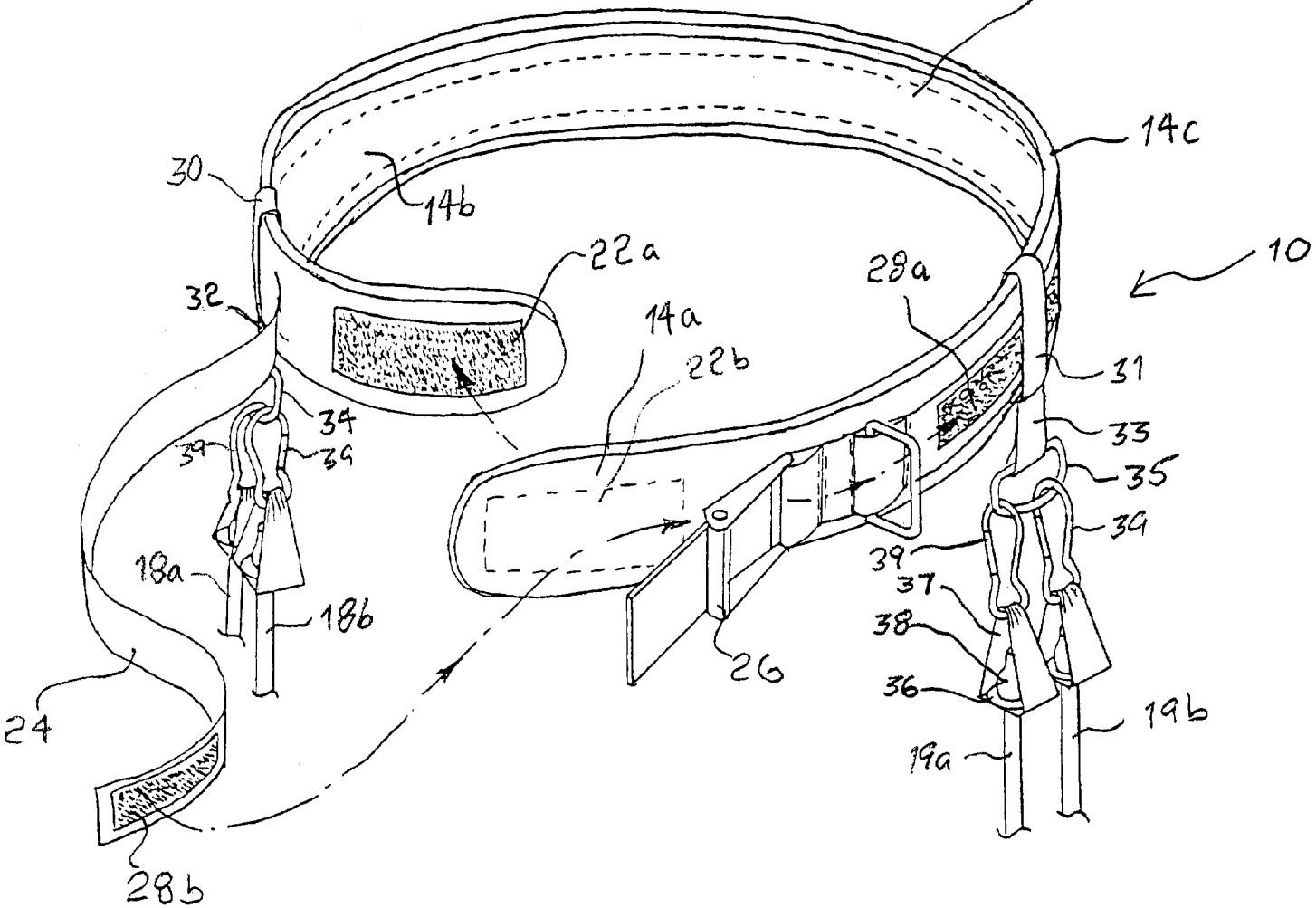
FIG. 2 is a perspective view of the belt portion of the training device of the present invention and the connections thereto.

The belt 14 of the training device 10 and the attachments thereto are shown more particularly in FIG. 2. As shown in FIG. 2, the belt 14 is similar in style to a weight lifter's belt and can be attached around the waist of the user in any way known in the art. In the embodiment shown in FIG. 2, the belt is attached by a hook and loop fastener 22*a*, 22*b* (e.g., Velcro) provided at each end of the belt 14. In the embodiment shown in FIG. 2, an additional fastening means can be provided, in this case, an extension 24 of the belt 14 can be fixed in buckle 26 and held in place on belt 14 after fastening with a hook and loop fastener (e.g., Velcro) 28*a*, 28*b*. Of course, other methods of securing the belt 14 to the waist of the athlete 12 could be used. Whatever method is used for securing the belt 14 to the waist of the athlete 12, the belt 14 is secured to the waist of the athlete 12 such that the belt has a front portion 14*a* adapted to be worn adjacent the navel of the athlete, a right side portion 14*b* adapted to be worn adjacent the right hip of the athlete 12, and a left side portion 14*c* adapted to be worn adjacent the left hip of the athlete 12.

Connections are also provided to attach the cords 18*a*, 18*b*, 19*a*, 19*b* to the belt 14. One embodiment is shown in FIG. 2, although other methods for connecting the cords 18*a*, 18*b*, 19*a*, 19*b* to the belt 14 could be used as would be understood by one skilled in the art. In the embodiment shown in FIG. 2, the cords 18*a*, 18*b* are secured to the belt 14 at a position between the front portion 14*a* and the right side portion 14*b*, while the cords 19*a*, 19*b* are connected to the belt at a position between the front portion 14*a* and the left side portion 14*c*. In the embodiment shown in FIG. 2, the connection includes a loop 30, 31 surrounding the belt 14. The loops 30, 31 can be formed of any strong and durable material, e.g., canvas or ballistic nylon and have receiving portions 32, 33 for rings 34, 35. The rings 34, 35 can be made of any high strength material, e.g., steel.

Depending on the sport for which the athlete is training, the cords 18*a*, 18*b*, 19*a*, 19*b* can be connected to the belt 14 at various locations around the belt 14. It is also possible to connect each cord of a pair of cords at two different, adjacent locations, e.g., to two different rings, rather than to the same ring. The connection locations shown in the embodiment of FIG. 2 (approximately midway between the front portion 14*a* and the right side portion 14*b*, and midway between the front portion 14*a* and the left side portion 14*c*) are useful, e.g., for training a hockey player. For a figure skater, for example, it may be advantageous for the connections of the outside cords 18*a*, 19*b* to be at the right side portion 14*b* and left side portion 14*c*, respectively. By the terms "between the front portion and the right side portion" and "between the front portion and the left side portion," applicant intends to include the end points, i.e., to encompass connections at the front portion and at the right side portion 14*b* and left side portion 14*c*, respectively.

Figure 6:
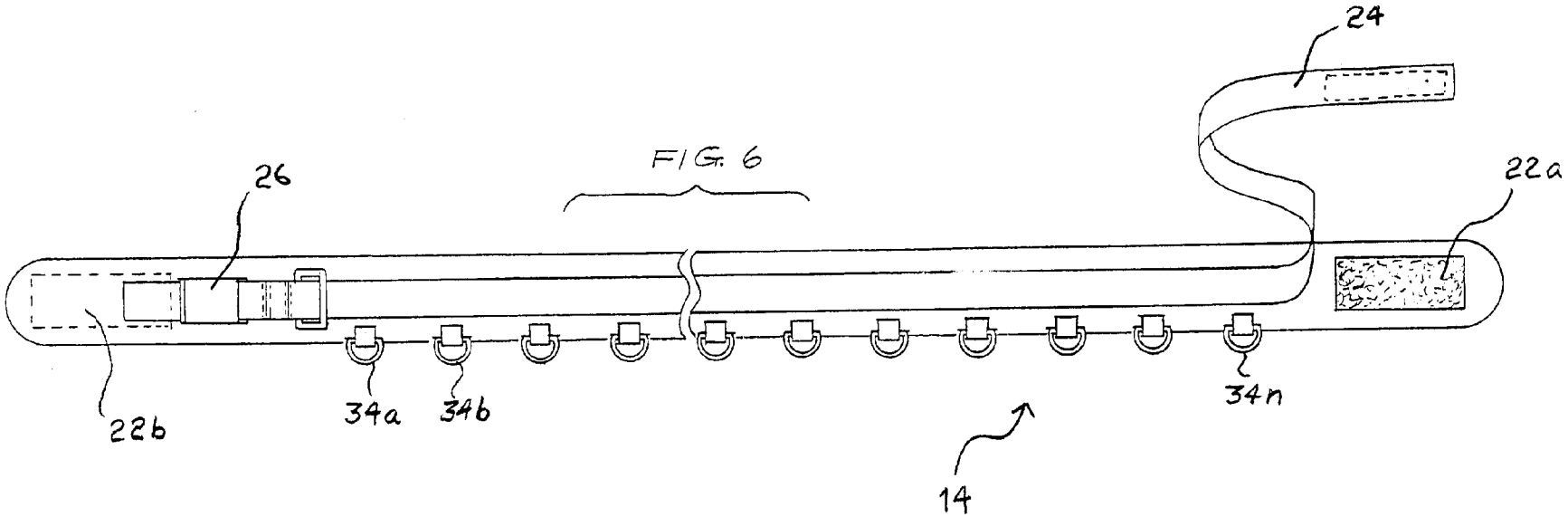
FIG. 6 is a schematic view of another embodiment of the belt portion of the training device of the present invention.

In an alternative embodiment shown in FIG. 6, the belt 14 can be provided with multiple connection locations, e.g., multiple rings 34*a*, 34*b* . . . 34*n* (only some of which are labeled for simplicity in FIG. 6) provided at spaced locations around the front half or, in the embodiment shown in FIG. 6, completely around the belt.

Each of the cords 18*a*, 18*b*, 19*a*, 19*b* has a mechanism for attaching it to the belt, e.g., in the embodiment shown in FIG. 2 to the rings 34 and 35. One such mechanism is shown in FIG. 2, although other mechanisms can be used as understood by one skilled in the art. As shown in FIG. 2, e.g., in connection with cord 19*a*, the cord 19*a* is passed through a reinforced eyelet 36 in a loop of material 37. A ball 38 having a diameter larger than the reinforced eyelet 36 is inserted in the cord 19*a* to permanently attach the cord 19*a* to the loop 37. Such an attachment is known and, does not per se form a part of the present invention. In the embodiment shown in FIG. 2, a carabiner or snap link 39 is used to attach the loop 37 to the ring 35. The carabiner 39 can be of a type typically used in mountaineering and provides a removable connection to the ring 35. In the embodiment shown in FIG. 2, each of the cords 18*a*, 18*b*, 19*a*, 19*b*, is attached to the belt 14, e.g., using a carabiner 39.

Figure 3:
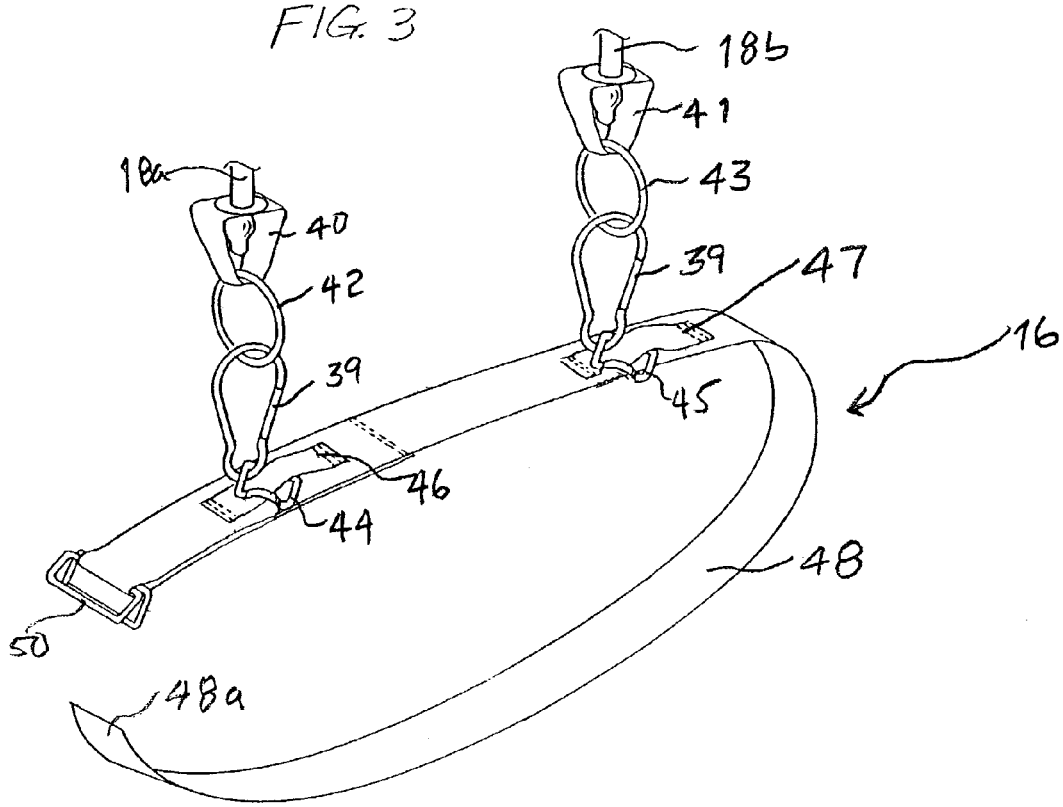
FIG. 3 is a perspective view of a foot attachment of a training device of the present invention and the connections thereto.

FIG. 3 shows one embodiment of a foot attachment 16 and the connections thereto. While FIG. 3 shows one embodiment connecting the cords 18*a*, 18*b* to the foot attachment 16, other connection mechanisms could be used as would be understood by one skilled in the art. As shown in FIG. 3, the cords 18*a*, 18*b*, are attached to groups of material 40, 41, respectively, in a similar manner as described in connection with the cords 19*a* and its attachment to the material loop 37. Of course, other connection mechanisms could be used. For ease of connection, rings 42, 43 are permanently attached to loops 40, 41, respectively, although the rings 42, 43 are not absolutely necessary and other connection mechanisms could be understood by one skilled in art. However, the rings 42, 43 provide convenient anchors for carabiners 39 which are used in this embodiment to connect the cords 18*a*, 18*b* to the foot attachment 16.

To facilitate this connection, in the embodiment shown in FIG. 3, the foot attachment 16 has loop portions 46, 47 attached to a band of material 48. The band 48 can be attached to the foot or footwear of the athlete, e.g., by fastening the end 48*a* through the double buckle 50. Rings 44, 45 are provided in loops 46, 47, respectively. The rings 42, 43 can be attached to the rings 44, 45, respectively by carabiners 39, although the rings 44, 45 can be omitted and the rings 42, 43 attached directly to loop portions 46, 47, for example. Other attachment mechanisms may be used as would be understood by one skilled in the art.

Figure 4:
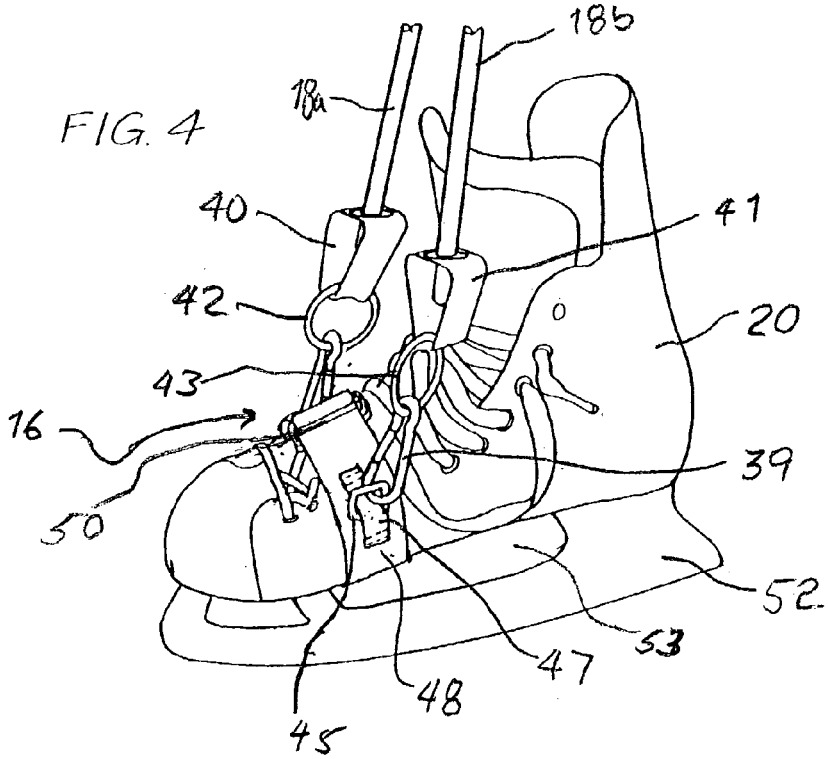
FIG. 4 is a perspective view of the foot attachment of FIG. 3 attached to an ice skate.

As shown more particularly in FIG. 4, the band 48 is wrapped around the skate 20 at a position just rearward of the toes. Typically, an ice skate 20 will have a cut-out portion 53 between the boot and blade 52 through which the band 48 can pass. The band 48 is fastened by pulling the end 48*a* through the double buckle 50 and secured to the skate 20 such that the loop portions 46, 47 are provided on either side of the central line of the foot just rearward of the toes.

Figure 5:
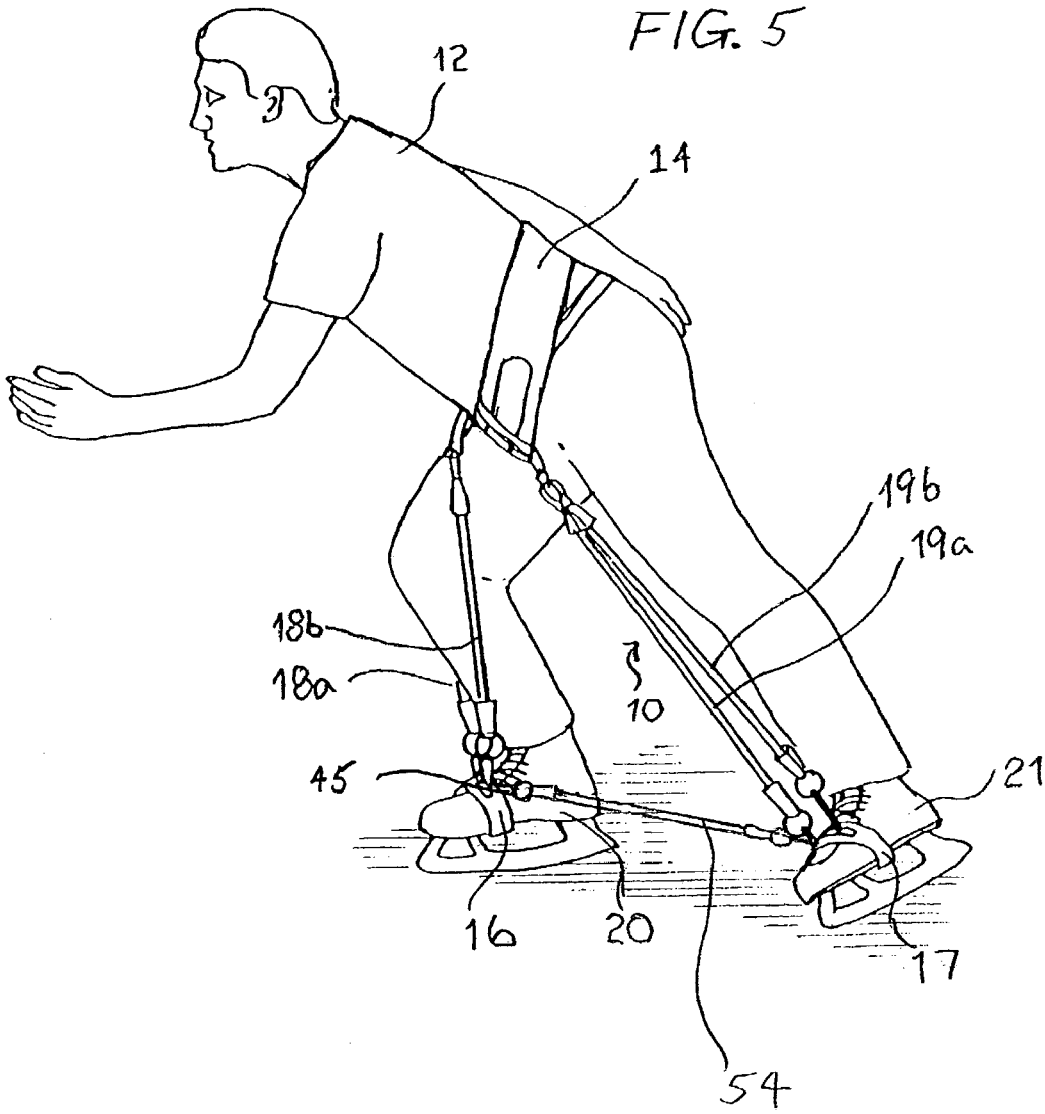
FIG. 5 is a schematic view of the training device of the present invention with an additional attachment being used by an ice skater.

Other elastic type cords can be utilized as additional features on this device. For example, a hockey player could attach a very small cord to the inside foot attachments of each foot in order to strengthen the abductors and adductors used during forward crossovers. Figure skaters could use the same attachment to develop better edge control. A snow skier could use this extra attachment in order to keep his skis together for a proper stance. For example, as shown in FIG. 5, an elastic cord 54 can be attached to rings 45 on the inside of each foot attachment 16, 17.

An extra cord may also be placed on the outside foot attachments of each foot so that when the feet are crossed and the skater is in motion extra emphasis is placed on his outside edges. This will promote better forward and backward crossovers, outside edge control, strength, and agility.

Experts in gliding sports could use the additional attachments in a variety of ways to enhance the athlete's skills.

The additional cords could be custom made in lengths and strengths to serve the individual purposes of each athlete.

One of the features of this device is that the cords are detachable. This allows the device to be customized by different types of gliding sport athletes. Skaters use both legs in a similar manner to perform their sport. Water-skiers, however, have a front foot and a back foot. One foot leads the way while the other follows. The same is true for most snowboarders, surfers, skateboarders, and wake boarders. In their case it would not be useful to have equal pressure on both legs. The detachable nature of the cords allows the athlete to take all four cords which originate from the waist, and attach the other ends at one foot, the front foot, thereby pushing the body weight forward, over the leading leg. The athlete could also select to have less pressure pushing forward by completely detaching one or more of the cords.

Some gliding sport athletes such as snowboarders and wake boarders have customized stances. Each athlete chooses the angle at which the feet are placed. Some are in a V shape, others an L shape, and there are a multitude of other correct positions. Some of these athletes also vary their stance depending on the type of riding they plan on doing at each session. With this device the athlete is free to customize his training equipment, just as he customizes his stance. There are no rules as to how the cords attach to the waist and feet, or as to how many the athlete uses at a time.

While the invention has been described in terms of its preferred embodiments, it should be understood that numerous modifications may be made thereto without departing from the spirit and scope of the invention as defined in the appended claims. It is intended that all such modifications fall within the scope of the appended claims.

I claim:

1. A training device for training a gliding sport athlete, comprising a belt for securing about the waist of the athlete, the belt having a front portion adapted to be worn adjacent the navel of the athlete, a right side portion adapted to be worn adjacent the right hip of the athlete, and a left side portion adapted to be worn adjacent the left hip of the athlete;

a pair of skates;

a pair of foot attachments, each of the pair of foot attachments being fastened to a front portion of a respective one of the pair of skates;

two pairs of stretchable cords, a first pair of cords having one end of each of the cords connected to the belt at a position between the front portion and the right side portion, and the other ends connected to one of the foot attachments, the belt and foot attachments being structured so as to position the first pair of cords on each side of the right knee of the athlete when in use, and a second pair of cords having one end of each of the cords connected to the belt at a position between the front portion and the left side portion, and the other ends connected to another of the foot attachments, the belt and foot attachments being structured so as to position the second pair of cords on each side of the left knee of the athlete when in use, each of the cords having an unstretched length less than a length between the athlete's waist and feet, the cords urging the legs of the athlete into positions with the knees of the athlete properly bent and forward of the toes.

2. The training device for training a gliding sport athlete according to claim 1, wherein the belt is provided with multiple connection mechanisms provided at spaced locations around the front half of the belt.

3. The training device for training a gliding sport athlete according to claim 2 wherein the multiple connection mechanisms comprise rings secured to the belt at spaced locations around a front half of the belt.

4. The training device for training a gliding sport athlete according to claim 3, wherein each cord of the two pairs of stretchable cords has a carabiner at the one end of each of the cord connected to a ring on the belt.

5. The training device for training a gliding sport athlete according to claim 1, wherein the belt includes at least one ring secured to the belt at a position between the front portion and the right side portion, and at least one ring secured to the belt at a position between the front portion and the left side portion.

6. The training device for training a gliding sport athlete according to claim 5, wherein each cord of the two pairs of stretchable cords has a carabiner at the one end of each of the cord connected to a ring on the belt.

7. The training device for training a gliding sport athlete according to claim 1, wherein each cord of the two pairs of stretchable cord has a carabiner at the another end connected to one of the foot attachments.

8. The training device for training a gliding sport athlete according to claim 1, wherein the skates are inline skates.

9. The training device for training a gliding sport athlete according to claim 1, wherein the skates are ice skates.

10. A combination of a training device for training a skating athlete and a pair of skates, comprising:

a pair of skates;

a belt for securing about the waist of the athlete, the belt having a right side portion adapted to be worn adjacent the right hip of the athlete, a left side portion adapted to be worn adjacent the left hip of the athlete, and a front portion to be worn in front of the athlete between the right and left side portions;

a pair of foot attachments, each of the pair of foot attachments being adapted to be fastened to a front portion of each of the pair of skates;

a plurality of stretchable cords having a first pair of lower ends connected to one of the foot attachments, a second pair of lower ends connected to another of the foot attachments and upper portions operably connected to the belt, the belt and foot attachments being structured so as to position an inside cord portion and an outside cord portion on each side of the right knee of the athlete when in use, and to position an inside cord portion and an outside cord portion on each side of the left knee of the athlete when in use, the inside and outside cord portions having an unstretched length less than a length between the athlete's waist and feet, the plurality of cords urging the legs of the athlete into positions with the knees of the athlete properly bent and forward of the toes.

11. The combination according to claim 10, wherein upper portions of the plurality of cords are operably connected to loops of durable material connected to and hanging from the belt at least at the front portion of the belt between the right and left side portions.

12. The combination according to claim 10, wherein upper portions of the plurality of cords are all operably connected to a front portion of the belt between the right and left side portions.

13. The combination according to claim 10, wherein each of the lower ends of the plurality of cords has a carabiner for attaching to the foot attachments.

14. The combination according to claim 13, wherein each foot attachment has a pair of loops and the carabiners at the lower ends of the plurality of cords attach to the loops of the foot attachments.

15. The combination according to claim 10, wherein the skates are inline skates.

16. The combination according to claim 10, wherein the skates are ice skates.

17. A combination of a training device for training a skating athlete and a pair of skates, comprising:

a pair of skates;

a belt for securing about the waist of the athlete, the belt having a right side portion adapted to be worn adjacent the right hip of the athlete, a left side portion adapted to be worn adjacent the left hip of the athlete, and a front portion to be worn in front of the athlete between the right and left side portions;

a pair of foot attachments, each of the pair of foot attachments being adapted to be fastened to a front portion of each of the pair of skates;

resistance means operably connected between the foot attachments and the belt for urging the legs of the athlete into positions with the knees of the athlete properly bent and forward of the toes.

18. The combination according to claim 17, wherein the resistance means is operably connected at all upper portions thereof to a front portion of the belt between the right and left side portions.

19. The combination according to claim 17, wherein the skates are inline skates.

20. The combination according to claim 17, wherein the skates are ice skates.

* * * * *